US008744089B2

(12) United States Patent
Moon et al.

(10) Patent No.: US 8,744,089 B2
(45) Date of Patent: Jun. 3, 2014

(54) METHOD AND APPARATUS FOR ENCODING AND DECODING STEREO AUDIO

(75) Inventors: Han-gil Moon, Seoul (KR); Jong-hoon Jeong, Suwon-si (KR)

(73) Assignee: Samsung Electronics, Suwon-si (KR)

( * ) Notice: Subject to any disclaimer, the term of this patent is extended or adjusted under 35 U.S.C. 154(b) by 316 days.

(21) Appl. No.: 12/868,077

(22) Filed: Aug. 25, 2010

(65) Prior Publication Data

US 2011/0051939 A1 Mar. 3, 2011

(30) Foreign Application Priority Data

Aug. 27, 2009 (KR) ..... 10-2009-0079769

(51) Int. Cl.
*H04R 5/00* (2006.01)

(52) U.S. Cl.
USPC ..... 381/23; 381/22; 704/500; 704/E19.001

(58) Field of Classification Search
USPC ..... 381/1, 17–18, 22–23; 704/500, E19.001
See application file for complete search history.

(56) References Cited

U.S. PATENT DOCUMENTS

| | | | | |
|---|---|---|---|---|
| 7,797,163 | B2 * | 9/2010 | Pang et al. | 704/500 |
| 7,965,848 | B2 * | 6/2011 | Villemoes et al. | 381/22 |
| 7,966,191 | B2 * | 6/2011 | Schuijers et al. | 704/500 |
| 2009/0164227 | A1 * | 6/2009 | Oh et al. | 704/500 |
| 2009/0228284 | A1 * | 9/2009 | Moon et al. | 704/500 |
| 2009/0287494 | A1 * | 11/2009 | Pang et al. | 704/500 |
| 2010/0310079 | A1 * | 12/2010 | Jung et al. | 381/1 |

* cited by examiner

*Primary Examiner* — Disler Paul
(74) *Attorney, Agent, or Firm* — Sughrue Mion, PLLC

(57) ABSTRACT

A method of encoding stereo audio that minimizes a number of pieces of side information required for parametric-encoding and parametric-decoding of the stereo audio. The side information may include parameters about interchannel intensity difference (IID), interchannel correlation (IC), overall phase difference (OPD), and interchannel phase difference (IPD), which are required to restore the mono audio to the stereo audio.

29 Claims, 9 Drawing Sheets

METHOD AND APPARATUS FOR ENCODING AND DECODING STEREO AUDIO

CROSS-REFERENCE TO RELATED PATENT APPLICATION

This application claims priority from Korean Patent Application No. 10-2009-0079769, filed on Aug. 27, 2009, in the Korean Intellectual Property Office, the disclosure of which is incorporated herein by reference in its entirety.

BACKGROUND OF THE INVENTION

1. Field of the Invention

The present invention relates to a method and apparatus for encoding and decoding stereo audio, and more particularly, to a method and apparatus for parametric-encoding and parametric-decoding stereo audio by minimizing the number of pieces of side information required for parametric-encoding and parametric-decoding the stereo audio.

2. Description of the Related Art

Generally, methods of encoding multi-channel (MC) audio include waveform audio coding and parametric audio coding. Examples of the waveform audio coding include moving picture experts group (MPEG)-2 MC audio coding, advanced audio coding (AAC) MC audio coding, and bit sliced arithmetic coding (BSAC)/audio video coding standard (AVS) MC audio coding.

In the parametric audio coding, an audio signal is encoded by analyzing a component of the audio signal, such as a frequency or amplitude, and parameterizing information about the component. When stereo audio is encoded by using the parametric audio coding, mono audio is generated by down-mixing right channel audio and left channel audio, and then the generated mono audio is encoded. Then, parameters about interchannel intensity difference (IID), interchannel correlation (IC), overall phase difference (OPD), and interchannel phase difference (IPD), which are required to restore the mono audio to the stereo audio, are encoded. Here, the parameters may also be called side information.

The parameters about IID and IC are encoded as information for determining the intensities of the left channel audio and the right channel audio, and the parameters about OPD and IPD are encoded as information for determining the phases of the left channel audio and the right channel audio.

SUMMARY OF THE INVENTION

The present invention provides a method and apparatus for parametric-encoding and parametric-decoding stereo audio by minimizing the number of pieces of side information required for performing parametric-encoding and parametric-decoding the stereo audio.

According to an aspect of the present invention, there is provided a method of encoding stereo audio, the method including: adding adjacent input audio signals to generate at least one beginning mono audio signal, the adjacent input audio signals being adjacent to each other among N received input audio signals of N channels of the stereo audio, if the at least one beginning mono audio signal is not a single final mono audio signal, consecutively adding adjacent mono audio signals to generate the single final mono audio signal; generating side information for restoring each of the mono audio signals obtained to generate the final mono audio signal and the final mono audio signal, encoding the final mono audio signal and the side information.

The method may further include: encoding the N input audio signals; decoding the encoded N input audio signals; and generating difference information about differences between the decoded N input audio signals and the N received input audio signals, wherein the encoding of the final mono audio signal and the side information comprises encoding the final mono audio signal, the side information, and the difference information.

The encoding of the side information may include: encoding information for determining intensities of each of the N input audio signals and the mono audio signals obtained to generate the final mono audio signal; and encoding information about phase differences between adjacent input audio signals and the mono audio signals obtained to generate the final mono audio signal.

The encoding of the information for determining intensities may include: generating a vector space in which a first vector and a second vector form a predetermined angle, wherein the first vector represents an intensity of a first one of adjacent input audio signals and the adjacent mono audio signals obtained to generate the final mono audio signal, and the second vector represents an intensity of a second one of the adjacent input audio signals and the adjacent mono audio signals obtained to generate the final mono audio signal; generating a third vector by adding the first vector and the second vector in the vector space; and encoding at least one of information about an angle between the third vector and the first vector and information about an angle between the third vector and the second vector, in the vector space.

The adding the adjacent input audio signals may comprise: if N is odd, selecting a first input audio signal among the N received input audio signals; creating two audio signals from the first input audio signal to generate an even number of audio signals; and adding the adjacent audio signals to generate the at least one beginning mono audio signal, and the consecutively adding adjacent mono audio signals to generate the single final mono audio signal may comprise: if the at least one beginning mono audio signal is not the single final mono audio signal, and if the at least one beginning mono audio signal is an odd number of mono audio signals, selecting a first beginning mono audio signal among the at least one beginning mono audio signal; creating two mono audio signals from the first beginning mono audio signal to generate an even number of mono audio signals; and consecutively adding the adjacent mono audio signals to generate the final mono audio signal.

The generating of the final mono audio signal, the generating of the side information, and the encoding of the side information may be performed in a predetermined frequency band.

According to another aspect of the present invention, there is provided a method of decoding stereo audio, the method including: extracting an encoded mono audio signal and encoded side information from received audio data; decoding the extracted mono audio signal and the extracted side information; and restoring at least two beginning restored audio signals from the decoded mono audio signal, if the at least two beginning restored audio signals are not N signals of the stereo audio, consecutively decoding the at least two beginning restored audio signals to generate the N final restored audio signals, based on the decoded side information.

The method may further include extracting difference information about differences between N decoded audio signals and N original audio signals from the audio data, wherein the N decoded audio signals are generated by decoding the N original audio signals, wherein the final restored audio signals are generated based on the decoded side information and the difference information.

The decoded side information may include: information for determining intensities of each of the beginning restored audio signals and the final restored audio signals; and information about phase differences between adjacent beginning restored audio signals and adjacent final restored audio signals.

The information for determining the intensities may include one of information about an angle between a first vector and a third vector and information about an angle between a second vector and the third vector in a vector space generated in which the first vector and the second vector form a predetermined angle, wherein the first vector represents an intensity of a first one of adjacent audio signals of the beginning restored audio signals and the final restored audio signals, and the second vector represents an intensity of a second one of the adjacent audio signals, and the third vector is the sum of the first and second vectors.

The restoring of the beginning restored audio signals may include: determining an intensity of at least one of a first beginning restored audio signal and a second beginning restored audio signal from among the adjacent beginning restored audio signals, by using at least one of the angle between the first vector and the third vector and the angle between the second vector and the third vector; calculating a phase of the first beginning restored audio signal and a phase of the second beginning restored audio signal based on information about a phase of the decoded mono audio signal and about a phase difference between the first beginning restored audio signal and the second beginning restored audio signal; and when the first beginning restored audio signal is restored based on the intensities and phases of the beginning restored audio signals, restoring the second beginning restored audio signal by subtracting the first beginning restored audio signal from the decoded mono audio signal, and when the second beginning restored audio signal is restored, restoring the first beginning restored audio signal by subtracting the second beginning restored audio signal from the decoded mono audio signal.

The restoring of the beginning restored audio signals may comprise combining one of the beginning restored audio signals that is restored based on at least one of the angle between the first vector and the third vector and the angle between the second vector and the third vector, and one of the beginning restored audio signals that is generated by subtracting one of the beginning restored audio signals from the decoded mono audio signal, in a predetermined ratio.

The restoring of the beginning restored audio signals may include: calculating a phase of a second beginning restored audio signal based on information about a phase of the decoded mono audio signal and information about a phase difference between the beginning restored audio signals; and restoring the beginning restored audio signals based on information about the phase of the decoded mono audio signal, information about the phase of the second beginning restored audio signal, and information for determining intensities of the beginning restored audio signals.

According to another aspect of the present invention, there is provided an apparatus for stereo encoding audio, the apparatus including: a mono audio generator that generates at least one beginning mono audio signal by adding adjacent input audio signals, the adjacent input audio signals being adjacent to each other among N received input audio signals of N channels of the stereo audio, and, if the at least one beginning mono audio signal is not a single final mono audio signal, consecutively adds adjacent mono audio signals to generate the single final mono audio signal; a side information generator that generates side information for restoring the N input audio signals and each of the mono audio signals obtained to generate the final mono audio signal, and the final mono audio signal; and an encoder that encodes the final mono audio signal and the side information.

The mono audio generator may include a plurality of down-mixers that each add two adjacent audio signals of at least one of the N input audio signals and the mono audio signals obtained to generate the final mono audio signal.

The apparatus may further include a difference information generator that encodes the N input audio signals, decodes the encoded N input audio signals, and generates difference information about differences between the N decoded input audio signals and the N received input audio signals, wherein the encoder encodes the difference information with the final mono audio signal and the side information.

According to another aspect of the present invention, there is provided an apparatus for decoding stereo audio, the apparatus including: an extractor that extracts an encoded mono audio signal and encoded side information from received audio data; a decoder that decodes the extracted mono audio signal and the extracted side information; and an audio restorer that restores at least one beginning restored audio signal from the decoded mono audio signal, and if the at least one beginning restored audio signal is at least one restored mono audio signal, generates N final restored audio signals by consecutively decoding the restored mono audio signal, based on the decoded side information.

The audio restorer may include a plurality of up-mixers that generate two restored audio signals from at least one of the decoded mono audio signal and the restored audio signals, based on the side information.

The extractor may further extract difference information about differences between N decoded audio signals and N original audio signals from the audio data, wherein the final restored audio signals may be generated based on the decoded side information and the difference information.

According to another aspect of the present invention, there is provided a computer readable recording medium having recorded thereon a program for executing a method of encoding stereo audio, the method including: adding adjacent input audio signals to generate at least one beginning mono audio signal, the adjacent input audio signals being adjacent to each other among N received input audio signals of N channels of the stereo audio, if the at least one beginning mono audio signal is not a single final mono audio signal, consecutively adding adjacent mono audio signals to generate the single final mono audio signal; generating side information for restoring each of the mono audio signals obtained to generate the final mono audio signal, and the final mono audio signal, while generating the final mono audio signal; and encoding the final mono audio signal and the side information.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF THE INVENTION

Hereinafter, the present invention will be described more fully with reference to the accompanying drawings, in which exemplary embodiments of the invention are shown.

Figure 1:
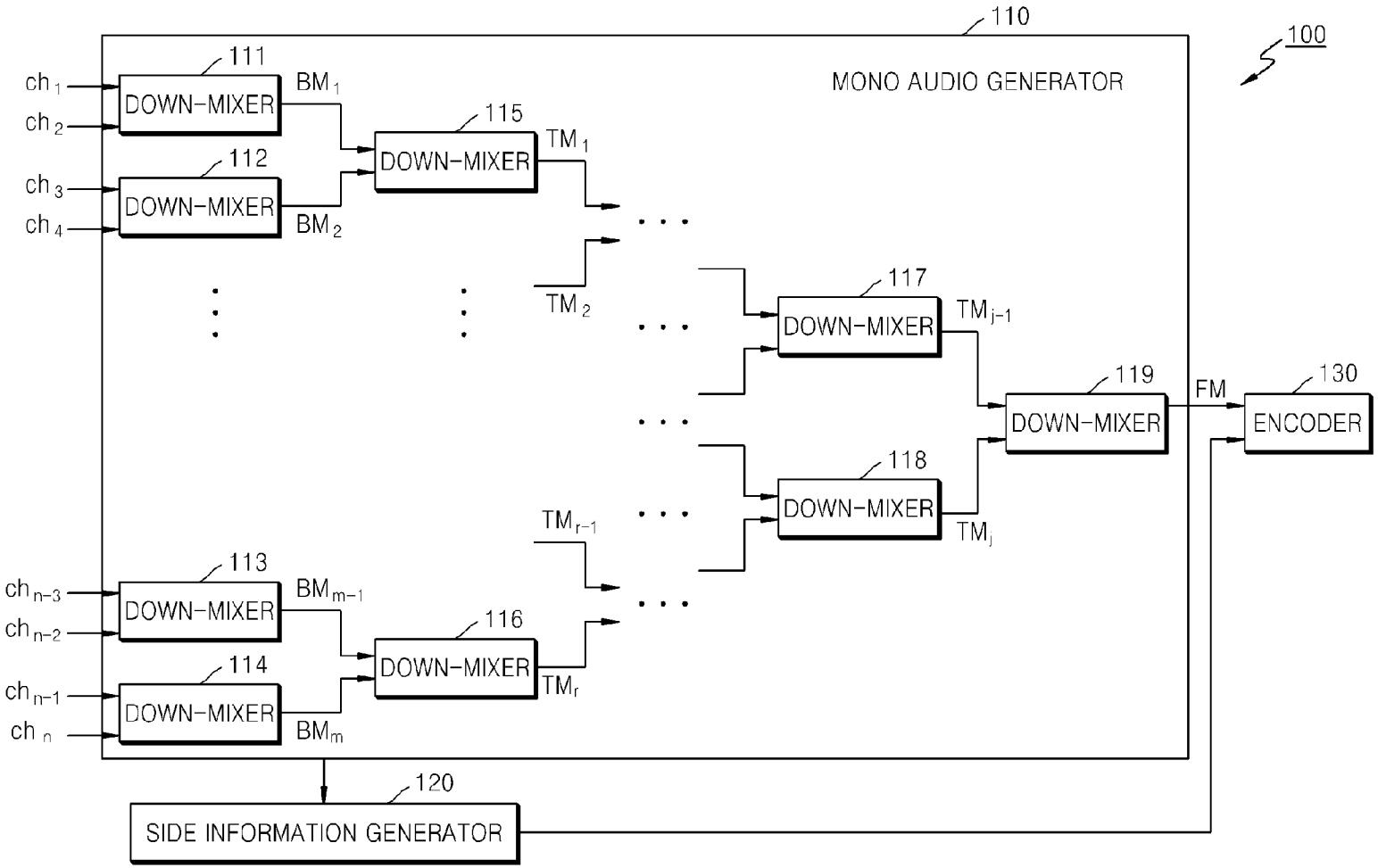
FIG. 1 is a diagram illustrating an apparatus for encoding audio, according to an exemplary embodiment of the present invention.

FIG. 1 is a diagram for describing an apparatus for encoding audio, according to an exemplary embodiment of the present invention.

Referring to FIG. 1, the apparatus 100 includes a mono audio generator 110, a side information generator 120, and an encoder 130, which may be implemented as hardware components of the apparatus for encoding audio for performing the functions thereof.

The mono audio generator 110 receives first through nth channel input audio signals Ch1 through Chn from N channels, generates first through mth beginning mono audio signals BM1 through BMm by adding adjacent input audio signals among the received first through nth channel input audio signals Ch1 through Chn, and generates a final mono audio signal FM. The final mono audio signal FM may be generated by iteratively performing the same adding method used to generate the first through mth beginning mono audio signals BM1 through BMm, where n and m are positive integers.

Here, since the two adjacent input audio signals among the signals Ch1 through Chn are added while generating the first through mth beginning mono audio signals BM1 through BMm, the adding method for obtaining the first through mth beginning mono audio signals BM1 through BMm is also performed according to each two adjacent audio signals among the mono audio signals BM1 through BMm. Also, as will be described later, if phases of the two adjacent input audio signals of the first through nth channel input audio signals Ch1 through Chn are adjusted to be the same while generating the first through mth beginning mono audio signals BM1 through BMm, the same adding method for obtaining the first through mth beginning mono audio signals BM1 through BMm is also performed after adjusting phases of two adjacent input audio signals among the mono audio signals BM1 through BMm.

Here, the mono audio generator 110 generates first through jth transient mono audio signals TM1 through TMj from the first through mth beginning mono audio signals BM1 through BMm, and the final mono audio signal FM, where j is a positive integer.

Also, as illustrated in FIG. 1, the mono audio generator 110 includes a plurality of down-mixers 111-119 that add adjacent audio signals of the first through nth channel input audio signals Ch1 through Chn, adjacent audio signals of the first through mth beginning mono audio signals BM1 through BMm, and adjacent audio signals of the first through jth transient mono audio signals TM1 through TMj. The final mono audio signal FM is generated through the plurality of down-mixers 111-119.

For example, a down-mixer 111, which received a first channel input audio signal Ch1 and a second channel input audio signal Ch2, generates a first beginning mono audio signal BM1 by adding the first and second channel input audio signals Ch1 and Ch2. Then, a down-mixer 115, which received the first beginning mono audio signal BM1 and a second beginning mono audio signal BM2, generates a first transient mono audio signal TM1.

Here, the down-mixers 111-119 may adjust a phase of one of two adjacent audio signals received as an input to be identical to a phase of the other of the two adjacent audio signals received as an input before adding the two adjacent audio signals. Accordingly, the down-mixers 111-119 may add phase adjusted adjacent audio signals, instead of adding the two adjacent audio signals as they are received. For example, before adding the first and second channel input audio signals Ch1 and Ch2, a phase of the second channel input audio signal Ch2 may be adjusted to be identical to a phase of the first channel input audio signal Ch1, thereby adding the phase-adjusted second channel input audio signal Ch2' with the first channel input audio signal Ch1. The details thereof will be described later.

Meanwhile, according to the current exemplary embodiment of the present invention, the first through nth channel input audio signals Ch1 through Chn transmitted to the mono audio generator 110 are considered to be digital signals. However, the first through nth channel input audio signals Ch1 through Chn may be analog signals according to another embodiment of the present invention, and the analog first through nth channel input audio signals Ch1 through Chn may be converted to digital signals before being input to the mono audio generator 110. The conversion may be accomplished by performing sampling and quantization on the first through nth channel input analog audio signals Ch1 through Chn.

The side information generator 120 generates side information for restoring each of the first through nth channel input audio signals Ch1 through Chn, the first through mth beginning mono audio signals BM1 through BMm, and the first through jth transient mono audio signals TM1 through TMj.

Here, whenever the down-mixers 111-119 included in the mono audio generator 110 add adjacent audio signals, the side information generator 120 generates side information required to restore the adjacent audio signals based on the result of adding the adjacent audio signals. Here, for convenience of description, the side information input from each down-mixer 111-119 to the side information generator 120 is not illustrated in FIG. 1.

Here, the side information includes information for determining intensities of each of the first through nth channel input audio signals Ch1 through Chn, intensities of the first through mth beginning mono audio signals BM1 through BMm, and intensities of the first through jth transient mono audio signals TM1 through TMj. The side information may also include information about phase differences between adjacent audio signals of the first through nth channel input audio signals Ch1 through Chn, adjacent audio signals of the first through mth beginning mono audio signals BM1 through BMm, and adjacent audio signals of the first through jth transient mono audio signals TM1 through TMj. The phase difference between adjacent audio signals denotes a difference between phases of audio signals that are added in a down-mixer.

According to another embodiment of the present invention, each down-mixer 111-119 may include the side information generator 120 in order to add the adjacent audio signals while generating the side information about the adjacent audio signals.

A method of generating the side information, wherein the method is performed by the side information generator 120, will be described in detail later with reference to FIGS. 2 through 4.

The encoder 130 encodes the final mono audio signal FM generated by the mono audio generator 110 and the side information generated by the side information generator 120.

Here, a method of encoding the final mono audio signal FM and the side information may be any general method used to encode mono audio and side information.

According to another exemplary embodiment of the present invention, the apparatus 100 may further include a difference information generator (not shown) which encodes the first through nth channel input audio signals Ch1 through Chn, decodes the encoded first through nth channel input audio signals Ch1 through Chn, and generates information about differences between the decoded first through nth channel input audio signals Ch1 through Chn and the original first through nth channel input audio signals Ch1 through Chn.

As such, when the apparatus includes the difference information generator, the encoder 130 may encode the information about differences along with the final mono audio signal FM and the side information. When the encoded mono audio signal generated by the apparatus is decoded, the information about differences is added to the decoded mono audio signal, so that audio signals that are similar to the original first through nth channel input audio signals Ch1 through Chn are generated.

According to another exemplary embodiment of the present invention, the apparatus 100 may further include a multiplexer (not shown), which generates a final bitstream by multiplexing the final mono audio signal FM and the side information that are encoded by the encoder 130.

A method of generating side information and a method of encoding the generated side information will now be described in detail. For convenience of description, the side information generated while the down-mixers 111-119 included in the mono audio generator 110 generate the first beginning mono audio signal BM1 by receiving the first and second channel input audio signals Ch1 and Ch2 will be described. Also, a case of generating information for determining intensities of the first and second channel input audio signals Ch1 and Ch2, and a case of generating information for determining phases of the first and second channel input audio signals Ch1 and Ch2 will be described.

(1) Information for Determining Intensity

According to parametric audio coding, each channel audio signal is changed to a frequency domain, and information about the intensity and phase of each channel audio signal is encoded in the frequency domain, as will be described in detail with reference to FIG. 2.

Figure 2:
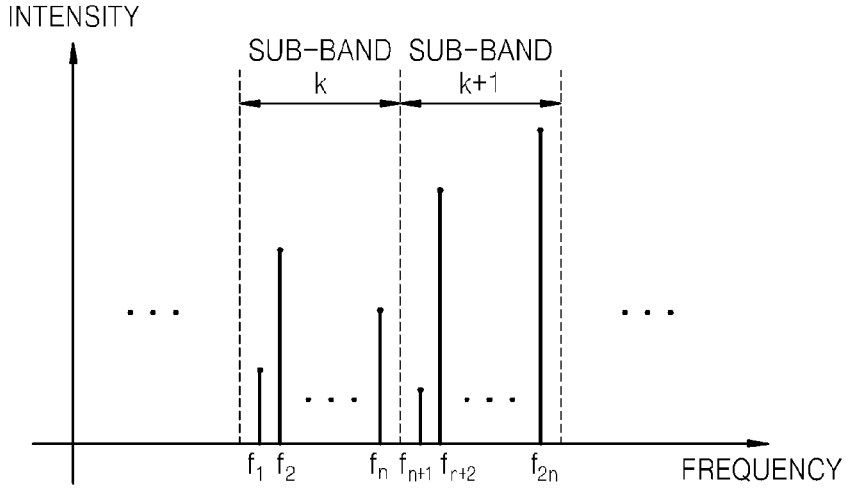
FIG. 2 is a diagram illustrating sub-bands in parametric audio coding.

FIG. 2 is a diagram illustrating sub-bands in parametric audio coding.

In detail, FIG. 2 illustrates a frequency spectrum in which an audio signal is converted to the frequency domain. When a fast Fourier transform is performed on the audio signal, the audio signal is expressed with discrete values in the frequency domain. In other words, the audio signal may be expressed as a sum of a plurality of sine curves.

In the parametric audio coding, when the audio signal is converted to the frequency domain, the frequency domain is divided into a plurality of sub-bands. Information for determining intensities of the first and second channel input audio signals Ch1 and Ch2, and information for determining phases of the first and second channel input audio signals Ch1 and Ch2 are encoded in each sub-band. Here, side information about intensity and phase in a sub-band k is encoded, and then side information about intensity and phase in a sub-band k+1 is encoded. As such, the entire frequency band is divided into sub-bands, and the side information is encoded according to each sub-band.

An example of encoding side information of the first and second channel input audio signals Ch1 and Ch2 in a predetermined frequency band, i.e., in the sub-band k, will now be described in relation to encoding and decoding of stereo audio having first through nth channel input audio signals.

When side information about stereo audio is encoded according to conventional parametric audio coding, information about interchannel intensity difference (IID) and information about interchannel correlation (IC) is encoded as information for determining intensities of the first and second channel input audio signals Ch1 and Ch2 in the sub-band k, as described above. Here, in the sub-band k, the intensity of the first channel input audio signal Ch1 and the intensity of the second channel input audio signal Ch2 are each calculated, and a ratio of the intensity of the first channel input audio signal Ch1 to the intensity of the second channel input audio signal Ch2 is encoded as the information about IID. However, the ratio alone is not sufficient to determine the intensities of the first and second channel input audio signals Ch1 and Ch2, and thus the information about IC is encoded as side information along with the ratio, and inserted into a bitstream.

A method of encoding audio, according to an exemplary embodiment of the present invention, uses a vector representing the intensity of the first channel input audio signal Ch1 in the sub-band k and a vector representing the intensity of the second channel input audio signal Ch2 in the sub-band k, in order to minimize the number of pieces of side information encoded as the information for determining the intensities of the first and second channel input audio signals Ch1 and Ch2 in the sub-band k. Here, an average value of intensities in frequencies f1 through fn in the frequency spectrum, in which the first channel input audio signal Ch1 is converted to the frequency domain, is the intensity of the first channel input audio signal Ch1 in the sub-band k, and also is a size of a vector Ch1 that will be described later.

Similarly, an average value of intensities in frequencies f1 through fn in the frequency spectrum, in which the second channel input audio signal Ch2 is converted to the frequency domain, is the intensity of the second channel input audio signal Ch2 in the sub-band k, and also is a size of a vector Ch2, as will be described in detail with reference to FIGS. 3A and 3B.

Figure 3A:
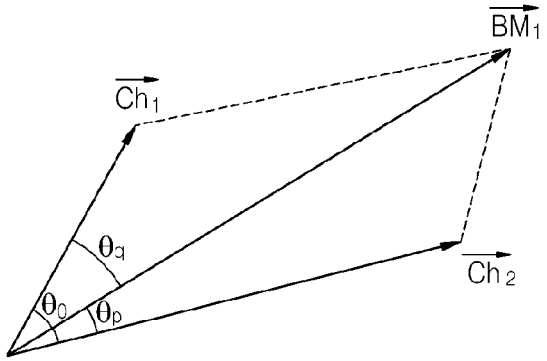
FIG. 3A is a diagram for describing a method of generating information about intensities of a first channel input audio signal and a second channel input audio signal, according to an exemplary embodiment of the present invention.

FIG. 3A is a diagram for describing a method of generating information about intensities of the first channel input audio signal Ch1 and the second channel input audio signal Ch2, according to an exemplary embodiment of the present invention.

Referring to FIG. 3A, the side information generator 120 generates a 2-dimensional (2D) vector space in which the vector Ch1, which is a vector representing the intensity of the first channel input audio signal Ch1 in the sub-band k, and the vector Ch2, which is a vector representing the intensity of the second channel input audio signal Ch2 in the sub-band k, form a predetermined angle $\theta_0$. If the first and second channel input audio signals Ch1 and Ch2 are respectively left audio and right audio, stereo audio is generally encoded assuming that a listener hears the stereo audio at a location where a left sound source direction and a right sound source direction form an angle of 60°. Accordingly, the predetermined angle $\theta_0$ between the vector Ch1 and the vector Ch2 in the 2D vector space may be 60°. However, according to the current embodiment of the present invention, since the first and second channel input audio signals Ch1 and Ch2 are not respectively left audio and right audio, the vector Ch1 and the vector Ch2 may have a predetermined angle $\theta_0$ other than 60°.

In FIG. 3A, a vector BM1, which is a vector about the intensity of the first beginning mono audio signal BM1 (obtained by adding the Ch1 vector and the Ch2 vector) is illustrated. Here, as described above, if the first and second channel input audio signals Ch1 and Ch2 respectively correspond to left audio and right audio, the listener, who listens to the stereo audio at the location where a left sound source direction and a right sound source direction form an angle of 60°, hears mono audio having an intensity corresponding to the size of the vector BM1 and in a direction of the vector BM1.

The side information generator 120 generates information about an angle θq between the BM1 vector and the Ch1 vector or an angle θp between the BM1 vector and the Ch2 vector, instead of the information about IID and about IC, as the information for determining the intensities of the first and second channel input audio signals Ch1 and Ch2 in the sub-band k.

Alternatively, instead of generating information about the angle θq or the angle θp, the side information generator 120 may generate a cosine value, such as cos θq or cos θp. This is because, a quantization process is performed when information about an angle is to be generated and encoded, and a cosine value of an angle is generated and encoded in order to minimize a loss occurring during the quantization process.

Figure 3B:
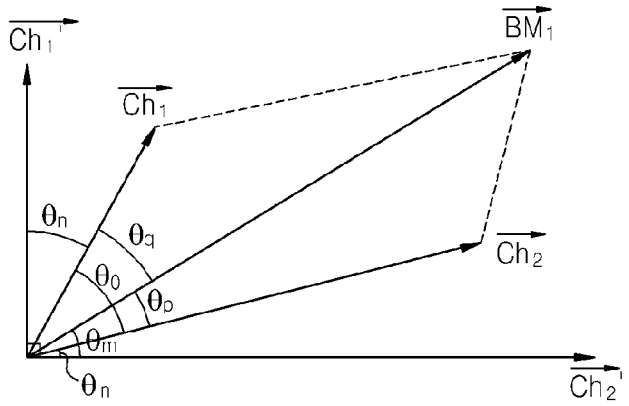
FIG. 3B is a diagram for describing a method of generating information about intensities of the first channel input audio signal and the second channel input audio signal, according to another exemplary embodiment of the present invention.

FIG. 3B is a diagram for describing a method of generating information about intensities of the first channel input audio signal Ch1 and the second channel input audio signal Ch2, according to another exemplary embodiment of the present invention.

In detail, FIG. 3B illustrates a process of normalizing a vector angle in FIG. 3A.

As shown in FIG. 3B, when the angle $\theta_0$ between the vector Ch1 and the vector Ch2 is not 90°, the angle $\theta_0$ may be normalized to 90°, and at this time, the angle θp or θq is also normalized.

When the angle $\theta_0$ is normalized to 90°, the angle θp is normalized accordingly, and thus $\theta m=(\theta p\times 90)/\theta_0$. The side information generator 120 may generate an un-normalized angle θp or a normalized angle θm as the information for determining the intensities of the first and second channel input audio signals Ch1 and Ch2. Alternatively, the side information generator 120 may generate cos θp or cos θm, instead of the angle θp or θm, as the information for determining the intensities of the first and second channel input audio signals Ch1 and Ch2.

(2) Information for Determining Phase

It has been described above that in the conventional parametric audio coding, information about overall phase difference (OPD) and information about interchannel phase difference (IPD) is encoded as information for determining the phases of the first and second channel input audio signals Ch1 and Ch2 in the sub-band k.

In other words, conventionally, the information about OPD is generated and encoded by calculating a phase difference between the first channel input audio signal Ch1 in the sub-band k and the first beginning mono audio signal BM1 generated by adding the first channel input audio signal Ch1 and the second channel input audio signal Ch2 in the sub-band k. Similarly, the information about IPD is generated and encoded by calculating a phase difference between the first channel input audio signal Ch1 and the second channel input audio signal Ch2 in the sub-band k. The phase difference may be obtained by calculating each of the phase differences at the frequencies $f_1$ through $f_n$ included in the sub-band and calculating the average of the calculated phase differences.

However, the side information generator 120 only generates information about a phase difference between the first and second channel input audio signals Ch1 and Ch2 in the sub-band k, as information for determining the phases of the first and second channel input audio signals Ch1 and Ch2.

According to an exemplary embodiment of the present invention, the down-mixer 111-119 generates the phase-adjusted second channel input audio signal Ch2' by adjusting the phase of the second channel input audio signal Ch2 to be identical to the phase of the first channel input audio signal Ch1, and then adds the phase-adjusted second channel input audio signal Ch2' with the first channel input audio signal Ch1. Thus, the phases of the first and second channel input audio signals Ch1 and Ch2 are each calculated only based on the information about the phase difference between the first and second channel input audio signals Ch1 and Ch2.

As an example of audio of the sub-band k, the phases of the second channel input audio signal Ch2 in the frequencies f1 through fn are each respectively adjusted to be identical to the phases of the first channel input audio signal Ch1 in the frequencies f1 through fn. An example of adjusting the phase of the second channel input audio signal Ch2 in the frequency f1 will now be described. When the first channel input audio signal Ch1 is expressed as $|Ch1|e^{i(2\pi f1t+\theta 1)}$ in the frequency f1, and the second channel input audio signal Ch2 is expressed as $|Ch2|e^{i(2\pi f1t+\theta 1)}$ in the frequency f1, the phase-adjusted second channel input audio signal Ch2' in the frequency f1 may be obtained as Equation 1 below. Here, θ1 denotes the phase of the first channel input audio signal Ch1 in the frequency f1 and θ2 denotes the phase of the second channel input audio signal Ch2 in the frequency f1.

$$Ch2'=Ch2\times e^{i(\theta 1-\theta 2)}=|Ch2|e^{i(2\pi f1t+\theta 1)} \quad \text{Equation 1}$$

According to Equation 1, the phase of the second channel input audio signal Ch2 in the frequency f1 is adjusted to be identical to the phase of the first channel input audio signal Ch1. The phases of the second channel input audio signal Ch2 are repeatedly adjusted in other frequencies f2 through fn in the sub-band k, thereby generating the phase-adjusted second input audio signal Ch2' in the sub-band k.

Since the phase of the phase-adjusted second channel input audio signal Ch2' is identical to the phase of the first channel input audio signal Ch1 in the sub-band k, a decoding unit for the first beginning mono audio signal BM1 can obtain the phase of the second channel input audio signal Ch2 when only the phase difference between the first and second channel input audio signals Ch1 and Ch2 is encoded. Since the phase of the first channel input audio signal Ch1 and the phase of the first beginning mono audio signal BM1 generated by the down-mixer are the same, information about the phase of the first channel input audio signal Ch1 does not need to be separately encoded.

Accordingly, when only the information about the phase difference between the first and second channel input audio signals Ch1 and Ch2 is encoded, the decoding unit can calculate the phases of the first and second channel input audio signals Ch1 and Ch2 by using the encoded information.

Meanwhile, the method of encoding the information for determining the intensities of the first and second channel input audio signals Ch1 and Ch2 by using intensity vectors of channel audio signals in the sub-band k, and the method of encoding the information for determining the phases of the first and second channel input audio signals Ch1 and Ch2 in the sub-band k by adjusting the phases, may be used independently or in combination. In other words, the information for determining the intensities of the first and second channel input audio signals Ch1 and Ch2 is encoded by using a vector according to the present invention, and the information about OPD and IPD may be encoded as the information for determining the phases of the first and second channel input audio signals Ch1 and Ch2 according to the conventional technology. Alternatively, the information about IID and IC may be encoded as the information for determining the intensities of the first and second channel input audio signals Ch1 and Ch2 according to the conventional technology, and only the information for determining the phases of the first and second channel input audio signals Ch1 and Ch2 may be encoded by using phase adjustment according to the present invention. Here, the side information may be encoded by using both methods according to the present invention.

Figure 4:
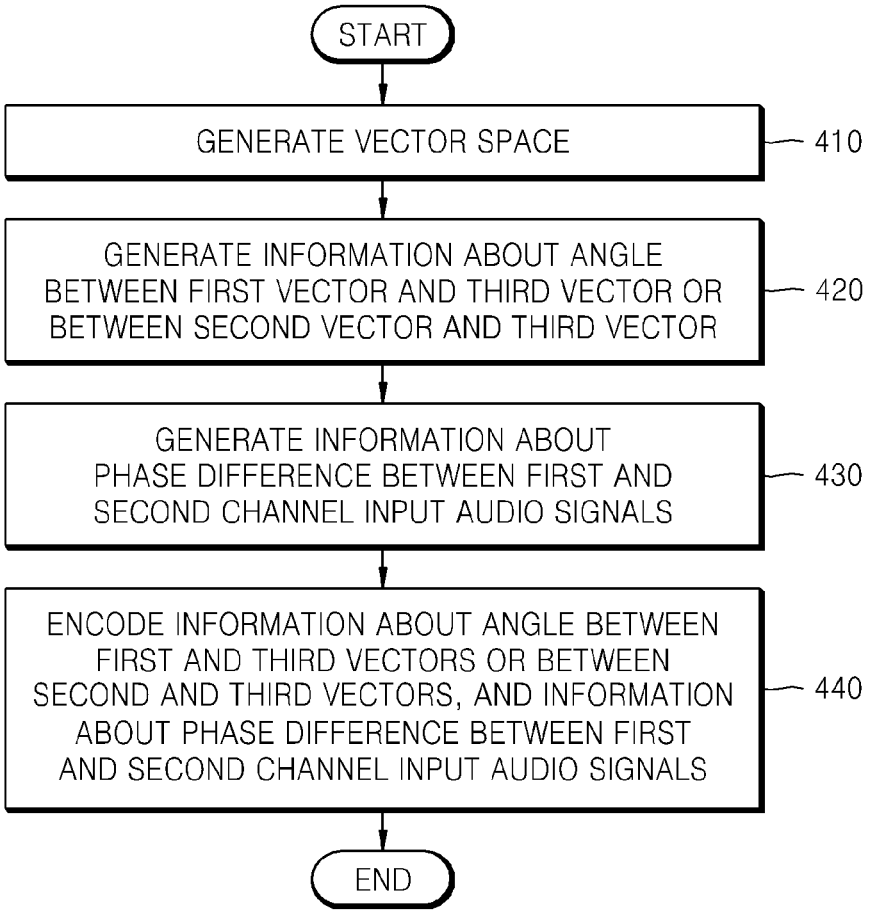
FIG. 4 is a flowchart illustrating a method of encoding side information, according to an exemplary embodiment of the present invention.

FIG. 4 is a flowchart illustrating a method of encoding side information, according to an exemplary embodiment of the present invention.

A method of encoding the information about the intensities and phases of the first and second channel input audio signals Ch1 and Ch2 in a predetermined frequency band, i.e., in the sub-band k, will now be described with reference to FIG. 4.

In operation 410, the side information generator 120 generates a vector space in which a first vector representing the intensity of the first channel input audio signal Ch1 in the sub-band k and a second vector representing the intensity of the second channel input audio signal Ch2 in the sub-band k form a predetermined angle.

Here, the side information generator 120 generates the vector space illustrated in FIG. 3A based on the intensities of the first and second channel input audio signals Ch1 and Ch2 in the sub-band k.

In operation 420, the side information generator 120 generates information about an angle between the first vector and a third vector or between the second vector and the third vector, wherein the third vector represents the intensity of the first beginning mono audio signal BM1 (generated by adding the first and second vectors in the vector space generated in operation 410).

Here, the information about the angle is the information for determining the intensities of the first and second channel input audio signals Ch1 and Ch2 in the sub-band k. Also, the information about the angle may be information about a cosine value of the angle, instead of the angle itself.

Here, the first beginning mono audio signal BM1 may be generated by adding the first and second channel input audio signals Ch1 and Ch2, or by adding the first channel input audio signal Ch1 and the phase-adjusted second channel input audio signal Ch2'. Here, the phase of the phase-adjusted second channel input audio signal Ch2' is identical to the phase of the first channel input audio signal Ch1 in the sub-band k.

In operation 430, the side information generator 120 generates the information about the phase difference between the first and second channel input audio signals Ch1 and Ch2.

In operation 440, the encoder 130 encodes the information about the angle between the first and third vectors or information about the angle between the second and third vectors, and the information about the phase difference between the first and second channel input audio signals Ch1 and Ch2.

The method of generating and encoding side information described above with reference to FIGS. 2 through 4 may be identically applied to generate side information for restoring audio signals that are added in each of the first through nth channel input audio signals Ch1 through Chn, the first through mth beginning mono audio signals BM1 through BMm, and the first through jth transient mono audio signals TM1 through TMj illustrated in FIG. 1.

Figure 5:
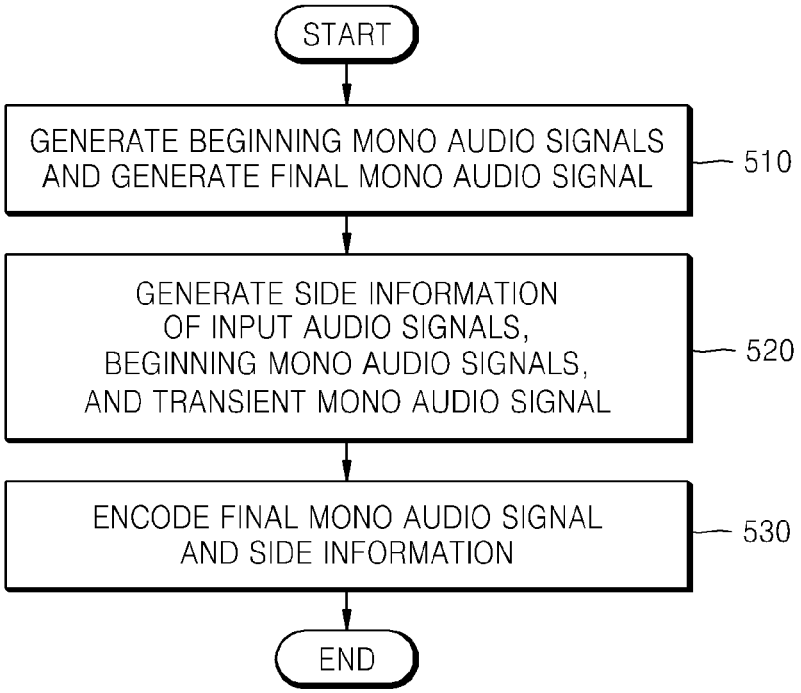
FIG. 5 is a flowchart illustrating a method of encoding audio, according to an exemplary embodiment of the present invention.

FIG. 5 is a flowchart illustrating a method of encoding audio, according to an exemplary embodiment of the present invention.

In operation 510, beginning mono audio signals are generated by adding adjacent input audio signals of N received input audio signals, and one final mono audio signal, which is generated by performing the same adding method on the beginning mono audio signals a plurality of times, where N is a positive integer.

In operation 520, side information for restoring the input audio signals, the beginning mono audio signals, and transient mono audio signals is generated.

In operation 530, the final mono audio signal and the side information are encoded.

Figure 6:
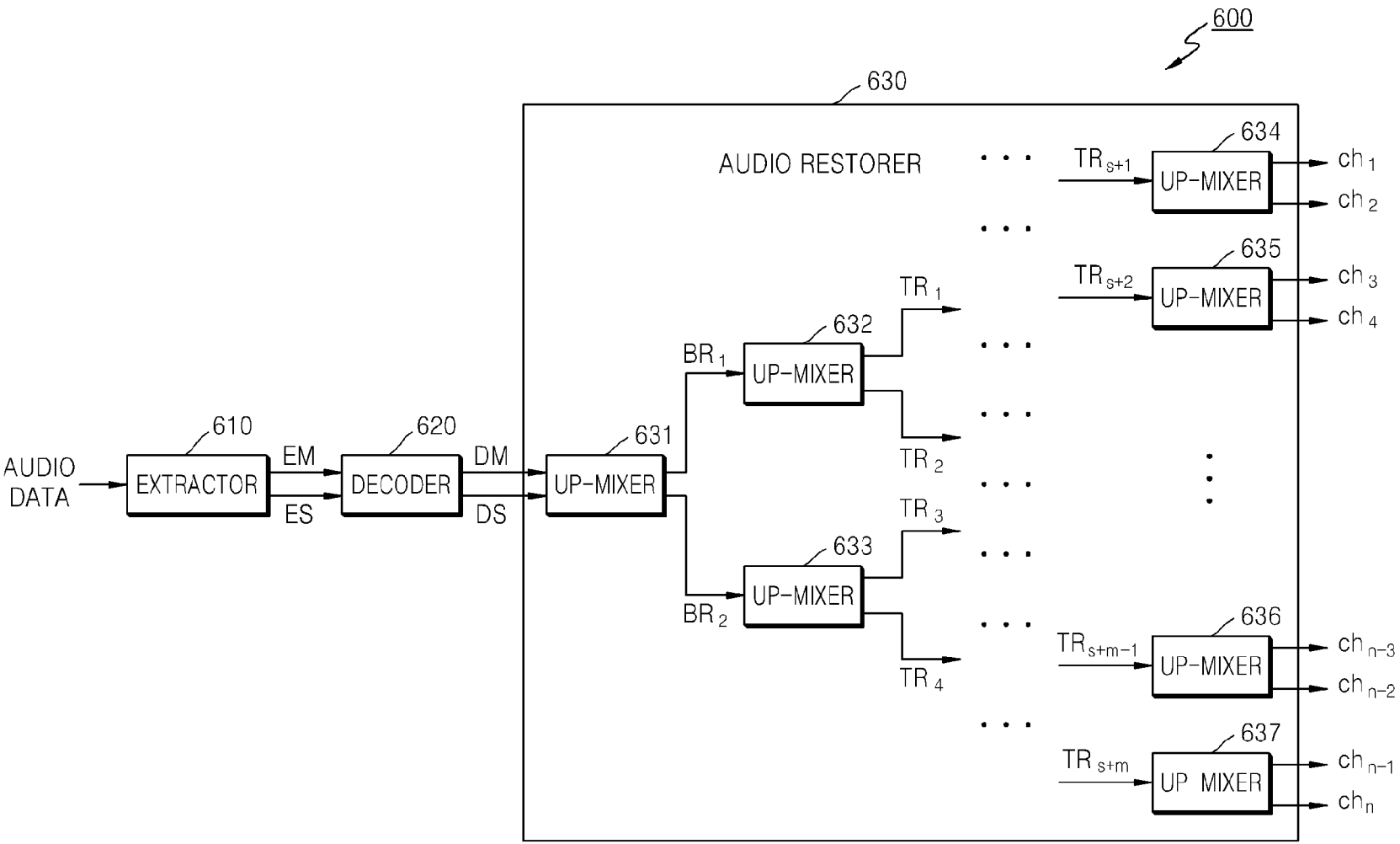
FIG. 6 is a diagram illustrating an apparatus for decoding audio, according to an exemplary embodiment of the present invention.

FIG. 6 is a diagram illustrating an apparatus for decoding audio, according to an exemplary embodiment of the present invention.

Referring to FIG. 6, the apparatus 600 includes an extractor 610, a decoder 620, and an audio restorer 630.

The extractor 610 extracts encoded mono audio signal EM and encoded side information ES from received audio data. Here, the extractor 610 may also be called a demultiplexer.

According to another exemplary embodiment of the present invention, the encoded mono audio signal EM and the encoded side information ES may be received instead of the audio data, and in this case, the extractor 610 may not be included in the apparatus 600.

The decoder 620 decodes the encoded mono audio signal EM and the encoded side information ES extracted by the extractor 610 to produce decoded side information DS and a decoded mono audio signal DM, respectively.

The audio restorer 630 restores two beginning restored audio signals BR1 and BR2 from the decoded mono audio signal DM based on the decoded side information DS. The audio restorer 630 generates N final restored audio signals Ch1 through Chn by consecutively applying the restoring method on the beginning restored audio signals BR1 and BR2.

Here, the audio restorer 630 generates transient restored audio signals TR1 through TRs+m while generating the final restored audio signals Ch1 through Chn from the beginning restored audio signals BR1 and BR2.

Also, as illustrated in FIG. 6, the audio restorer 630 includes a plurality of up-mixers 631-637, which generate two restored audio signals from each one of the beginning restored audio signals BR1 and BR2. The up-mixers 631-637 generate the transient restored audio signals TR1 through TRs+m from the restored audio signals, and generate the final restored audio signals Ch1 through Chn from the transient restored audio signals TR1 through TRs+m.

In FIG. 6, the decoded side information DS is transmitted to the up-mixers 631-637 included in the audio restorer 630 through the decoder 620, but for convenience of description, the decoded side information DS transmitted to each of the up-mixers 631-637 is not illustrated.

Meanwhile, according to another exemplary embodiment of the present invention, if the extractor 610 further extracts information about differences between N decoded audio signals, which are generated by encoding and decoding encoded N original audio signals that are to be restored from the audio data through the N final restored audio signals, and the N original audio signals, the information about the differences is decoded by using the decoder 620. The decoded information about the differences may be added to each of the final restored audio signals Ch1 through Chn generated by the audio restorer 630. Accordingly, the final restored audio signals Ch1 through Chn are similar to the N original audio signals.

Operations of an up-mixer 634 will now be described in detail. Here, for convenience of description, the up-mixer 634 receives an s+1th transient restored audio signal TRs+1 and restores the first and second channel input audio signals Ch1 and Ch2 as final restored audio signals from the transient restored audio signal TRs+1.

Referring to the vector space illustrated in FIG. 3A, the up-mixer 634 uses information about an angle between a vector BM1 and a vector Ch1 or information about an angle between the vector BM1 and a vector Ch2 as information for determining intensities of the first and second channel input audio signals Ch1 and Ch2 in the sub-band k, wherein the vector BM1 represents the intensity of the s+1th transient restored audio signal TRs+1, the vector Ch1 represents the intensity of the first channel input audio signal Ch1, and the vector Ch2 represents the intensity of the second channel input audio signal Ch2. The up-mixer 634 may use information about a cosine value of the angle between the vector BM1 and the vector Ch1 or between the vector BM1 and the vector Ch2.

Referring to FIG. 3B, when an angle $\theta_0$ between the vector Ch1 and the vector Ch2 is 60°, the size of the intensity of the first channel input audio signal Ch1, i.e., the size of the vector Ch1, may be calculated according to $|Ch1|=|BM1|\times\sin\theta m/\cos(\pi/12)$. Here, $|BM1|$ denotes the size of the intensity of the s+1th transient restored audio signal TRs+1, i.e., the size of the vector BM1, and an angle between the vector Ch1 and a vector Ch1' is 15°. Similarly, when an angle $\theta_0$ between the vector Ch1 and the vector Ch2 is 60°, the size of the intensity of the second channel input audio signal Ch2, i.e., the size of the vector Ch2, may be calculated according to $|Ch2|=|BM1|\times\cos\theta m/\cos(\pi/12)$. However, here, an angle between the vector Ch2 and a vector Ch2' is 15°.

Also, the up-mixer 634 may use information about a phase difference between the first and second channel input audio signals Ch1 and Ch2 as information for determining phases of the first and second channel input audio signals Ch1 and Ch2 in the sub-band k. When the phase of the second channel input audio signal Ch2 is already adjusted to be identical to the phase of the first channel input audio signal Ch1 while encoding the s+1th transient restored audio signal TRs+1, the up-mixer 634 may calculate the phases of the first and second channel input audio signals Ch1 and Ch2 by using only the information about the phase difference between the first and second channel input audio signals Ch1 and Ch2.

Meanwhile, the method of decoding the information for determining the intensities of the first and second channel input audio signals Ch1 and Ch2 in the sub-band k by using a vector, and the method of decoding the information for determining the phases of the first and second channel input audio signals Ch1 and Ch2 in the sub-band k by using phase adjustment, as described above, may be used independently or in combination.

Figure 7:
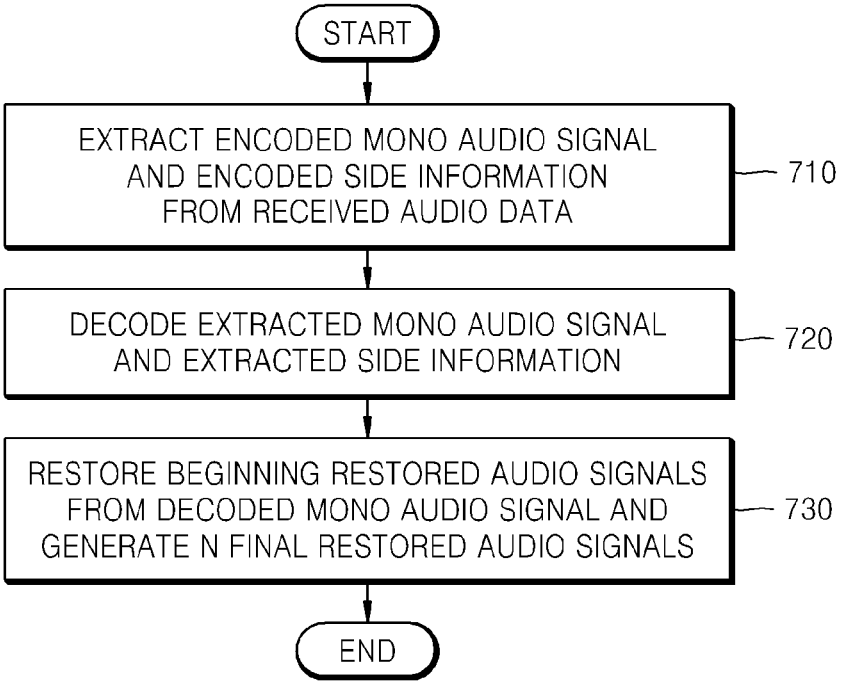
FIG. 7 is a flowchart illustrating a method of decoding audio, according to an embodiment of the present invention.

FIG. 7 is a flowchart illustrating a method of decoding audio, according to an exemplary embodiment of the present invention.

In operation 710, encoded mono audio signal EM and encoded side information ES are extracted from received audio data.

In operation 720, the extracted mono audio signal EM and the extracted side information ES are decoded.

In operation 730, two beginning restored audio signals BR1 and BR2 are restored from the decoded mono audio signal DM. The N final restored audio signals Ch1 through Chn are restored by consecutively applying the same decoding method on the two beginning restored audio signals BR1 and BR2, based on the decoded side information DS.

Here, transient restored audio signals TR1 through TRs+m are generated from the beginning restored audio signals BR1 and BR2.

According to another exemplary embodiment of the present invention, when the final restored audio signals Ch1 through Chn are generated, the generated final restored audio signals Ch1 through Chn may be converted and output as analog signals.

Figure 8:
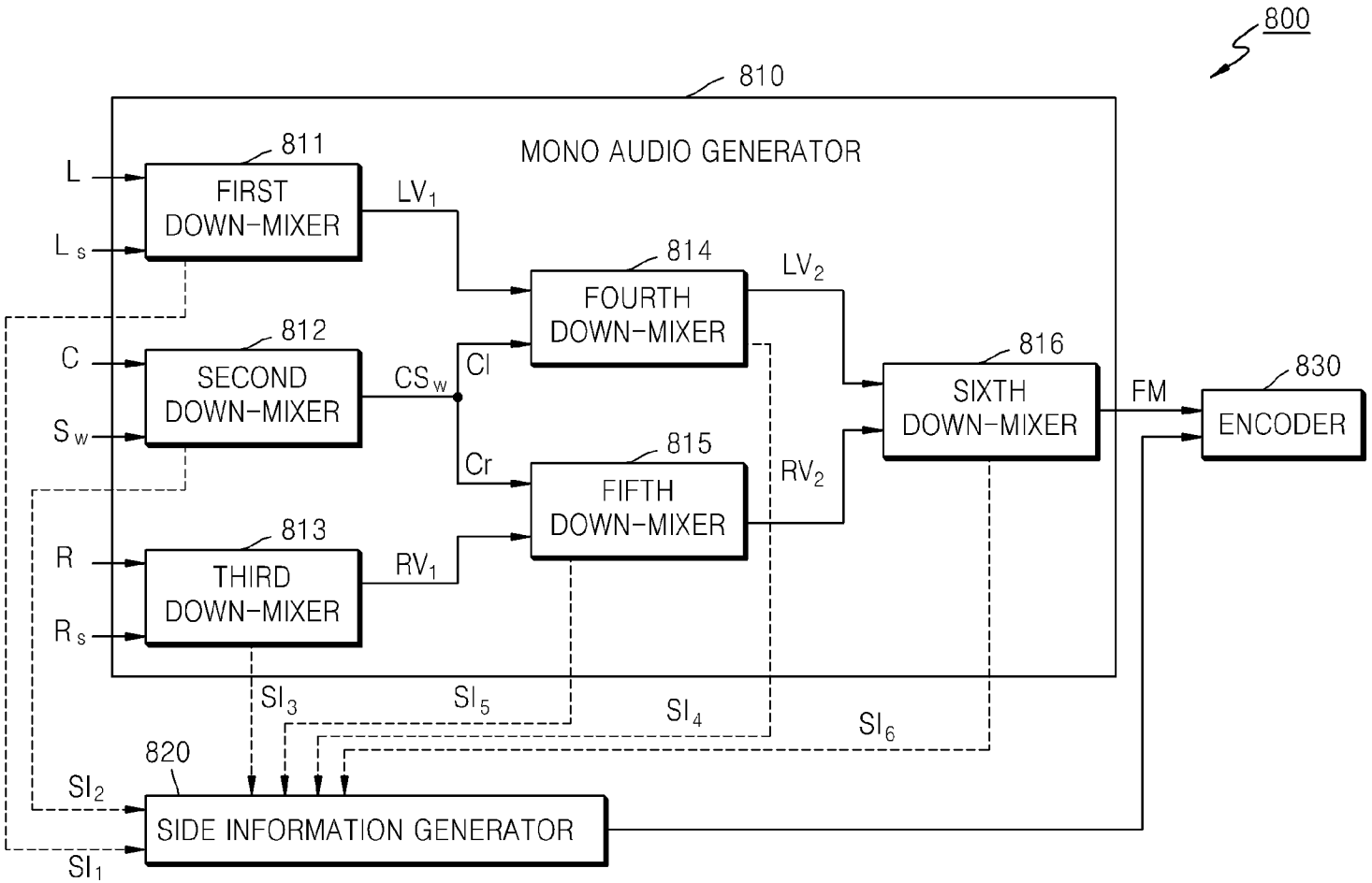
FIG. 8 is a diagram illustrating an apparatus for encoding 5.1-channel stereo audio, according to an exemplary embodiment of the present invention.

FIG. 8 is a diagram illustrating an apparatus for encoding 5.1-channel stereo audio, according to an exemplary embodiment of the present invention.

Referring to FIG. 8, the apparatus 800 includes a mono audio generator 810, a side information generator 820, and an encoder 830. Audio signals input to the apparatus 800 include a left channel front audio signal L, a left channel rear audio signal Ls, central audio signal C, a sub-woofer audio signal Sw, a right channel front audio signal R, and right channel rear audio signal Rs.

Operations of the mono audio generator 810 will now be described.

The mono audio generator includes a plurality of down-mixers 811-816. A first down-mixer 811 generates a signal $LV_1$ by adding the left channel front audio signal L and the left channel rear audio signal Ls, a second down-mixer 812 generates a signal CSw by adding the central audio signal C and the sub-woofer audio signal Sw, and a third down-mixer 813 generates a signal $RV_1$ by adding the right channel front audio signal R and the right channel rear audio signal Rs.

Here, the first through third down-mixers 811 through 813 may adjust phases of two audio signals to be identical before adding the two audio signals.

Meanwhile, the second down-mixer 812 generates signals C1 and Cr from the generated CSw. This is because the number of audio signals output from the first to third down mixers 811 to 813, which are to be input to fourth and fifth down-mixers 814 and 815 is 3, i.e., an odd number. Accordingly, the second down-mixer 812 divides the signal CSw into the signals C1 and the Cr so that the fourth and fifth down-mixers 814 and 815 each receive two audio signals. Here, the signals C1 and the Cr each have a size obtained by multiplying CSw by 0.5, but the sizes of the signals C1 and the Cr are not limited thereto and any value may be used for the multiplication.

The fourth down-mixer 814 generates a signal $LV_2$ by adding the signals $LV_1$ and C1, and the fifth down-mixer 815 generates a signal $RV_2$ by adding the signals $RV_1$ and Cr.

A sixth down-mixer 816 generates a final mono audio signal FM by adding the signals $LV_2$ and the $RV_2$.

Here, the signals $LV_1$, the $RV_1$, and the signal CSw correspond to the beginning mono audio signals BMs described above, and the signals $LV_2$ and the $RV_2$ correspond to the transient mono audio signals TMs described above.

The side information generator 820 receives side information SI1 through SI6 from the first through sixth down-mixers 811 through 816, or reads the side information SI1 through SI6 from the first through sixth down-mixers 811 through 816 and then outputs the side information SI1 through SI6 to the encoder 830. Here, dotted lines in FIG. 8 indicate that the side information S1 through SI6 is transmitted from the first through sixth down-mixers 811 through 816 to the side information generator 820.

The encoder 830 encodes the final mono audio signal FM and the side information SI1 through SI6.

Figure 9:
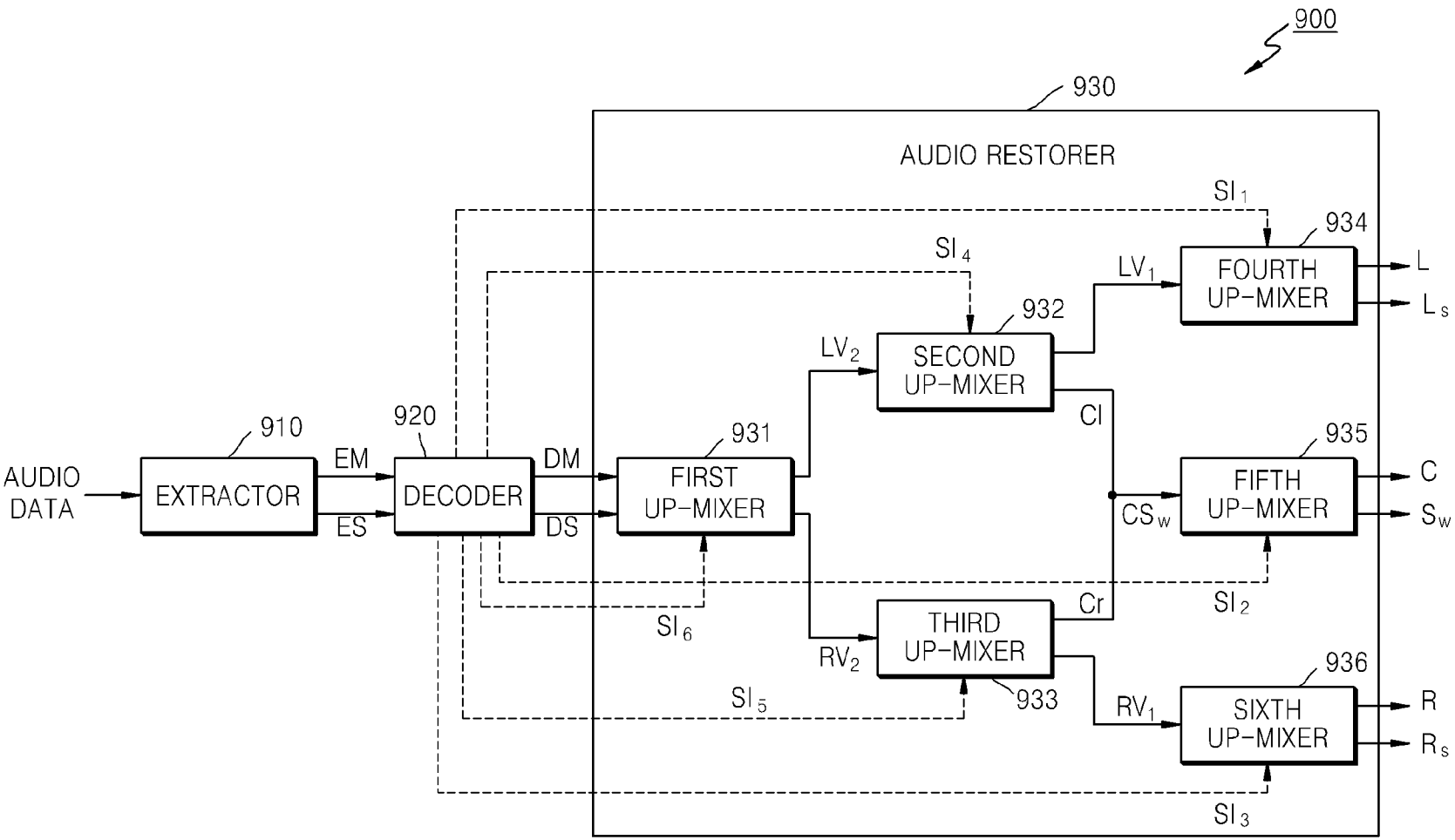
FIG. 9 is a diagram illustrating an apparatus for decoding 5.1-channel stereo audio, according to an exemplary embodiment of the present invention.

FIG. 9 is a diagram illustrating an apparatus for decoding 5.1-channel stereo audio, according to an exemplary embodiment of the present invention.

Referring to FIG. 9, the apparatus 900 includes an extractor 910, a decoder 920, and an audio restorer 930. The operations of the extractor 910 and the decoder 920 of FIG. 9 are respectively similar to those of the extractor 610 and the decoder 620 of FIG. 6, and thus details thereof are omitted herein. The operations of the audio restorer 930 will now be described in detail.

The audio restorer 930 includes a plurality of up-mixers 931-936. A first up-mixer 931 restores signals $LV_2$ and $RV_2$ from decoded mono audio signal DM.

Here, first through sixth up-mixers 931 through 936 perform restoration based on decoded side information SI1 through SI6 received from the decoder 920.

The second up-mixer 932 restores signals $LV_1$ and C1 from the signal $LV_2$, and the third up-mixer 933 restores signals $RV_1$ and Cr from the signal $RV_2$.

The fourth up-mixer 934 restores signals L and Ls from the signal $LV_1$, the fifth up-mixer 935 restores signals C and Sw from signal CSw, which is generated by combining the signals C1 and Cr, and the sixth up-mixer 936 restores signals R and Rs from the signal $RV_1$.

Here, the signals $LV_2$ and the $RV_2$ correspond to the beginning restored audio signals BRs described above, and the signals $LV_1$, the CSw, and the $RV_1$ correspond to the transient restored audio signals TRs described above.

A method of restoring audio signals performed by the first through sixth up-mixers 931 through 936 will now be described in detail. Hereinafter, the operations of the fourth up-mixer 934 will be described with reference to FIG. 10.

Figure 10:
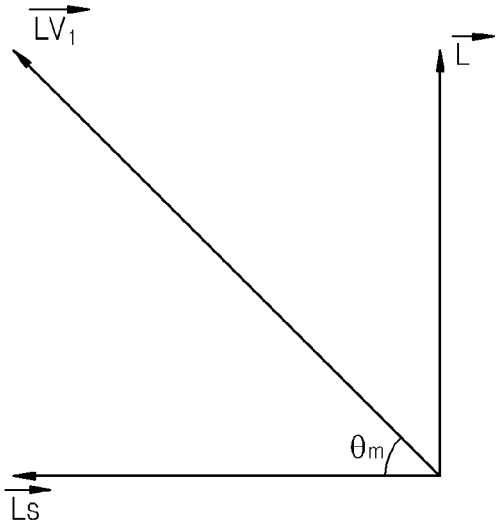
FIG. 10 is a diagram for describing an operation of an up-mixer, according to an exemplary embodiment of the present invention.

FIG. 10 is a diagram for describing the operations of the fourth up-mixer 934, according to an exemplary embodiment of the present invention.

Referring to FIG. 10, a 2D vector space includes a vector L representing an intensity of a left channel front audio signal L in a sub-band k, and an vector LS representing an intensity of a left channel rear audio signal Ls in the sub-band k form an angle of 90°, and a vector $LV_1$ representing an intensity of a vector $LV_1$ generated by adding the left channel front audio signal L and the left channel rear audio signal Ls.

Various methods of restoring the left channel front audio signal L and the left channel rear audio signal Ls will now be described.

A first method is to restore the left channel front audio signal L and the left channel rear audio signal Ls by using an angle between the vector $LV_1$ and the vector Ls as described above. In other words, the size of the vector Ls is calculated according to $|LV_1|\cos\theta m$ and the size of the vector L is calculated according to $|LV_1|\sin\theta m$ so as to determine the intensity of the left channel front audio signal L and the intensity of the left channel rear audio signal Ls. Then, the phases of the left channel front audio signal L and the left channel rear audio signal Ls are calculated based on side information. Accordingly, the left channel front audio signal L and the left channel rear audio signal Ls are restored.

In a second method, when the left channel front audio signal L and the left channel rear audio signal Ls are restored according to the first method, the left channel front audio signal L is restored by subtracting the left channel rear audio signal Ls from the beginning mono audio signal $LV_1$, and the left channel rear audio signal Ls is restored by subtracting the left channel front audio signal L from the beginning mono audio signal $LV_1$.

A third method is to restore audio signals by combining audio signals restored according to the first method and audio signals restored according to the second method in a predetermined ratio.

In other words, when the left channel front audio signal L and the left channel rear audio signal Ls restored according to the first method are respectively referred to as Ly and Lsy, and the left channel front audio signal L and the left channel rear audio signal Ls restored according to the second method are respectively referred to as Lz and Lsz, the intensities of the left channel front audio signal L and the left channel rear audio signal Ls are respectively determined according to $|L|=a\times|Ly|+(1-a)\times|Lz|$ and $|Ls|=a\times|Lsy|+(1-a)\times|Lsz|$. The phases of the left channel front audio signal L and the left channel rear audio signal Ls are calculated based on side information, thereby restoring the left channel front audio signal L and the left channel rear audio signal Ls. Here, "a" is a value between 0 and 1.

FIG. 10 illustrates a case when the vector L and the vector Ls form an angle of 90°, but when an angle between the vector Cr and the vector $RV_1$ is not 90°, as in the Cr and the $RV_1$ of FIG. 9, the signals $RV_1$ and the Cr may be restored by normalizing the angle as shown in FIG. 3B, and then using the normalized angle.

For example, referring to FIG. 3B, the signal Cr corresponds to the vector Ch1, the signal $RV_1$ corresponds to the vector Ch2, and the signal $RV_2$ corresponds to the vector BM1. When the sizes of the signals Cr and $RV_1$ are calculated by using the normalized vector angle illustrated in FIG. 3B, $|Cr|=|RV_2|\sin\theta m/\cos\theta n$ and $|RV_1|=|RV_2|\cos\theta m/\cos\theta n$. Based on this, the signals Cr and $RV_1$ are restored by applying the first through third methods on the signals Cr and $RV_1$.

The embodiments of the present invention may be written as computer programs and can be implemented in general-use digital computers that execute the programs using a computer readable recording medium. Examples of the computer readable recording medium may include magnetic storage media (e.g., ROM, floppy disks, hard disks, etc.), optical recording media (e.g., CD-ROMs, or DVDs), and storage media.

While this invention has been particularly shown and described with reference to preferred embodiments thereof, it will be understood by those of ordinary skill in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A method of encoding stereo audio, the method comprising:

adding adjacent input audio signals to generate at least one beginning mono audio signal, the adjacent input audio signals being adjacent to each other among N received input audio signals of N channels of the stereo audio;

if the at least one beginning mono audio signal is not a single final mono audio signal, consecutively adding adjacent mono audio signals to generate the single final mono audio signal;

generating side information for restoring the N input audio signals, each of the mono audio signals obtained to generate the final mono audio signal and the final mono audio signal; and encoding the final mono audio signal and the side information, wherein the encoding of the side information comprises encoding information for determining intensities of each of the N input audio signals and the mono audio signals obtained to generate the final mono audio signal, wherein the encoding of the information for determining intensities comprises generating a third vector by adding a first vector and a second vector; and encoding at least one of information about an angle between the third vector and the first vector and information about an angle between the third vector and the second vector.

2. The method of claim 1, further comprising:

encoding the N input audio signals;

decoding the encoded N input audio signals; and generating difference information about differences between the decoded N input audio signals and the N received input audio signals, wherein the encoding of the final mono audio signal and the side information comprises encoding the final mono audio signal, the side information, and the difference information.

3. The method of claim 1, wherein the encoding of the side information comprises encoding information about phase differences between adjacent input audio signals and the adjacent mono audio signals obtained to generate the final mono audio signal.

4. The method of claim 1, wherein the adding the adjacent input audio signals comprises:

if N is odd, selecting a first input audio signal among the N received input audio signals;

creating two audio signals from the first input audio signal to generate an even number of audio signals; and adding the adjacent audio signals to generate the at least one beginning mono audio signal, and wherein the consecutively adding adjacent mono audio signals to generate the single final mono audio signal comprises:

if the at least one beginning mono audio signal is not the single final mono audio signal, and if the at least one beginning mono audio signal is an odd number of mono audio signals, selecting a first beginning mono audio signal among the at least one beginning mono audio signal;

creating two mono audio signals from the first beginning mono audio signal to generate an even number of mono audio signals; and consecutively adding the adjacent mono audio signals to generate the final mono audio signal.

5. The method of claim 1, wherein the generating of the final mono audio signal, the generating of the side information, and the encoding of the side information are performed in a predetermined frequency band.

6. The method of claim 1, wherein the encoding of the information for determining intensities further comprises:

generating a vector space in which the first vector and the second vector form a predetermined angle, wherein the first vector represents an intensity of a first one of adjacent input audio signals and the adjacent mono audio signals obtained to generate the final mono audio signal, and the second vector represents an intensity of a second one of the adjacent input audio signals and the mono audio signals obtained to generate the final mono audio signal.

7. A method of decoding stereo audio, the method comprising:

extracting an encoded mono audio signal and encoded side information from received audio data;

decoding the extracted mono audio signal and the extracted side information; and restoring at least two beginning restored audio signals from the decoded mono audio signal, if the at least two beginning restored audio signals are not N signals of the stereo audio, consecutively decoding the at least two beginning restored audio signals to generate the N final restored audio signals, based on the decoded side information, wherein the decoded side information comprises information for determining intensities of each of the beginning restored audio signals and the final restored audio signals, and wherein the information for determining the intensities comprises at least one of information about an angle between a first vector and a third vector and information about an angle between a second vector and the third vector, and wherein the third vector is the sum of the first and second vectors.

8. The method of claim 7, further comprising extracting difference information about differences between N decoded audio signals and N original audio signals from the audio data, wherein the N decoded audio signals are generated by decoding encoded N original audio signals, wherein the final restored audio signals are generated based on the decoded side information and the difference information.

9. The method of claim 7, wherein the decoded side information comprises information about phase differences between adjacent beginning restored audio signals and adjacent final restored audio signals.

10. The method of claim 7, wherein a vector space is generated in which the first vector and the second vector form a predetermined angle, and wherein the first vector represents an intensity of a first one of adjacent audio signals of the beginning restored audio signals and the final restored audio signals, and the second vector represents an intensity of a second one of the adjacent audio signals.

11. The method of claim 10, wherein the restoring of the beginning restored audio signals comprises:

determining an intensity of at least one of a first beginning restored audio signal and a second beginning restored audio signal from among the adjacent beginning restored audio signals, by using at least one of the angle between the first vector and the third vector and the angle between the second vector and the third vector;

calculating a phase of the first beginning restored audio signal and a phase of the second beginning restored audio signal based on information about a phase of the decoded mono audio signal and about a phase difference between the first beginning restored audio signal and the second beginning restored audio signal; and when the first beginning restored audio signal is restored based on the intensities and phases of the beginning restored audio signals, restoring the second beginning restored audio signal by subtracting the first beginning restored audio signal from the decoded mono audio signal, and when the second beginning restored audio signal is restored, restoring the first beginning restored audio signal by subtracting the second beginning restored audio signal from the decoded mono audio signal.

12. The method of claim 10, wherein the restoring of the beginning restored audio signals comprises combining one of the beginning restored audio signals that is restored based on at least one of the angle between the first vector and the third vector and the angle between the second vector and the third vector, and one of the beginning restored audio signals that is generated by subtracting one of the beginning restored audio signals from the decoded mono audio signal, in a predetermined ratio.

13. The method of claim 10, wherein the restoring of the beginning restored audio signals comprises:

calculating a phase of a second beginning restored audio signal based on information about a phase of the decoded mono audio signal and information about a phase difference between the beginning restored audio signals; and restoring the beginning restored audio signals based on information about the phase of the decoded mono audio signal, information about the phase of the second beginning restored audio signal, and information for determining intensities of the beginning restored audio signals.

14. An apparatus for encoding stereo audio, the apparatus comprising:

a mono audio generator that generates at least one beginning mono audio signal by adding adjacent input audio signals, the adjacent input audio signals being adjacent to each other among N received input audio signals of N channels of the stereo audio, and, if the at least one beginning mono audio signal is not a single final mono audio signal, consecutively adds adjacent mono audio signals to generate the single final mono audio signal;

a side information generator that generates side information for restoring the N input audio signals and each of the mono audio signals obtained to generate the final mono audio signal, and the final mono audio signal; and an encoder that encodes the final mono audio signal and the side information, wherein the encoder generates a third vector by adding a first vector and a second vector and encodes at least one of information about an angle between the third vector and the first vector and an information about an angle between the third vector and the second vector, for determining intensities of each of the N input audio signals and the mono audio signals obtained to generate the final mono audio signal.

15. The apparatus of claim 14, wherein the mono audio generator comprises a plurality of down-mixers that each add two adjacent audio signals of at least one of the N input audio signals and the mono audio signals obtained to generate the final mono audio signal.

16. The apparatus of claim 14, further comprising a difference information generator that encodes the N input audio signals, decodes the encoded N input audio signals, and generates difference information about differences between the N decoded input audio signals and the N received input audio signals, wherein the encoder encodes the difference information with the final mono audio signal and the side information.

17. The apparatus of claim 14, wherein the encoder encodes information about phase differences between adjacent audio signals of the N input audio signals and the beginning mono audio signals obtained to generate the final mono audio signal.

18. The apparatus of claim 14, wherein the mono audio generator, if N is odd, selects a first input audio signal among the N received input audio signals, creates two audio signals from the first input audio signal to generate an even number of audio signals, and adds the adjacent signals to generate the at least one beginning mono audio signal, and wherein the audio generator, if the at least one beginning mono audio signal is not the single final mono audio signal and if the at least one beginning mono audio signal is an odd number of audio signals, selects a first beginning mono audio signal among the at least one beginning mono audio signals, creates two mono audio signals from the first beginning mono audio signal to generate an even number of mono audio signals, and consecutively adds the adjacent mono audio signals to generate the final mono audio signal.

19. The apparatus of claim 14, wherein the mono audio generator, the side information generator, and the encoder perform the operations in a predetermined frequency band.

20. The apparatus of claim 14, wherein the encoder generates a vector space in which the first vector and the second vector form a predetermined angle, wherein the first vector represents an intensity of a first one of adjacent input audio signals and the beginning mono audio signals obtained to generate the final mono audio signal, and the second vector represents an intensity of a second one of the adjacent input audio signals and the mono audio signals obtained to generate the final mono audio signal.

21. An apparatus for decoding stereo audio, the apparatus comprising:

an extractor that extracts an encoded mono audio signal and encoded side information from received audio data;

a decoder that decodes the extracted mono audio signal and the extracted side information; and an audio restorer that restores at least one beginning restored audio signal from the decoded mono audio signal, and if the at least one beginning restored audio signal is at least one restored mono audio signal, generates N final restored audio signals by consecutively decoding the restored mono audio signal, based on the decoded side information, wherein the decoded side information comprises information for determining intensities of the beginning restored audio signals, the restored mono audio signals, and the final restored audio signals, and wherein the information for determining the intensities comprises at least one of information about an angle between a first vector and a third vector and information about an angle between a second vector and the third vector, and the third vector is the sum of the first and second vectors.

22. The apparatus of claim 21, wherein the audio restorer comprises a plurality of up-mixers that generate two restored audio signals from at least one of the decoded mono audio signal and the restored audio signals based on the side information.

23. The apparatus of claim 21, wherein the extractor further extracts difference information about differences between N decoded audio signals and N original audio signals from the audio data, wherein the N decoded audio signals are generated by decoding encoded N original audio signals, wherein the final restored audio signals are generated based on the decoded side information and the difference information.

24. The apparatus of claim 21, wherein the decoded side information further comprises information about phase differences between each of the adjacent audio signals of each of the beginning restored audio signals, the restored mono audio signals, and the final restored audio signals.

25. The apparatus of claim 24, wherein the audio restorer calculates a phase of a second beginning restored audio signal based on information about a phase of the decoded mono audio signal and information about a phase difference between the beginning restored audio signals, and restores the beginning restored audio signals based on information about the phase of the decoded mono audio signal, information about the phase of the second beginning restored audio signal, and information for determining intensities of the beginning restored audio signals.

26. The apparatus of claim 21, wherein a vector space is generated in which the first vector and the second vector forms a predetermined angle, wherein the first vector represents an intensity of a first one of adjacent beginning restored audio signals, restored mono audio signals, and final restored audio signals, the second vector represents an intensity of a second one of the adjacent beginning restored audio signals, restored mono audio signals, and final restored audio signals.

27. The apparatus of claim 26, wherein the audio restorer, determines an intensity of at least one of a first beginning restored audio signal and a second beginning restored audio signal, by using at least one of the angle between the first vector and the third vector and the angle between the second vector and the third vector, calculates a phase of the first beginning restored audio signal and a phase of the second beginning restored audio signal based on information about a phase of the decoded mono audio signal and information about a phase difference between the first beginning restored audio signal and the second beginning restored audio signal, and when the first beginning restored audio signal is restored based on the intensities and phases of the beginning restored audio signals, restores the second beginning restored audio signal by subtracting the first beginning restored audio signal from the decoded mono audio signal, and when the second beginning restored audio signal is restored, restores the first beginning restored audio signal by subtracting the second beginning restored audio signal from the decoded mono audio signal.

28. The apparatus claim 26, wherein the audio restorer restores one of the first and second beginning restored audio signal by combining one of the beginning restored audio signals that is restored based on at least one of the angle between the first vector and the third vector and the angle between the second vector and the third vector, and one of the beginning restored audio signals that is generated by subtracting one of the beginning restored audio signals from the decoded mono audio signal, in a predetermined ratio.

29. A non-transitory computer readable recording medium having recorded thereon a program for executing the method of claim 1.

* * * * *